United States Patent [19]

Ray et al.

[11] 4,137,075

[45] Jan. 30, 1979

[54] METALLIC GLASSES WITH A COMBINATION OF HIGH CRYSTALLIZATION TEMPERATURES AND HIGH HARDNESS VALUES

[75] Inventors: Ranjan Ray, Morristown; Lee E. Tanner, Summit, both of N.J.; Carl F. Cline, Walnut Creek, Calif.

[73] Assignee: Allied Chemical Corporation, Morris Township, Morris County, N.J.

[21] Appl. No.: 800,107

[22] Filed: May 25, 1977

Related U.S. Application Data

[63] Continuation-in-part of Ser. No. 764,661, Jan. 17, 1977, abandoned, which is a continuation of Ser. No. 495,458, Aug. 7, 1974, abandoned.

[51] Int. Cl.[2] ..... C22C 27/02; C22C 27/04; C22C 30/00

[52] U.S. Cl. ..... 75/174; 75/122; 75/123 B; 75/134 F; 75/170; 75/176

[58] Field of Search ..... 75/122, 134 F, 123, 75/174, 176, 170

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 75/122 |
| 3,986,867 | 10/1976 | Masumoto et al. | 75/126 |
| 4,056,411 | 11/1977 | Chen et al. | 148/101 |
| 4,067,732 | 1/1978 | Ray | 75/134 F |

*Primary Examiner*—Arthur J. Steiner
*Attorney, Agent, or Firm*—Ernest D. Buff; Gerhard H. Fuchs

[57] ABSTRACT

Glassy metal alloys which include substantial amounts of one or more of the refractory metals of molybdenum, tungsten, tantalum and niobium evidence both high thermal stability, with a high crystallization temperature of at least about 700° C, and a high hardness of at least about 1000 kg/mm$^2$.

14 Claims, No Drawings

METALLIC GLASSES WITH A COMBINATION OF HIGH CRYSTALLIZATION TEMPERATURES AND HIGH HARDNESS VALUES

This is a continuation-in-part application of Ser. No. 764,661, filed Jan. 17, 1977, now abandoned, which in turn is a continuation application of Ser. No. 495,458, filed Aug. 7, 1974, now abandoned.

BACKGROUND OF THE INVENTION

A. Field of the Invention

The invention relates to glassy metal alloy compositions, and, in particular, to compositions including substantial amounts of one or more of the refractory metals of molybdenum, tungsten, tantalum and niobium. The glassy compositions of the invention evidence a combination of high crystallization temperatures and high hardness values.

B. Description of the Prior Art

Investigations have demonstrated that it is possible to obtain solid glassy metals for certain alloy compositions. A glassy substance generally characterizes a noncrystalline substance; that is, a substance substantially lacking any long range order. In distinguishing a glassy substance from a crystalline substance, X-ray diffraction measurements are generally suitably employed. Additionally, transmission electron micrography and electron diffraction can be used to distinguish between the glassy and the crystalline state.

A glassy metal produces an X-ray diffraction profile in which intensity varies slowly with diffraction angle. Such a profile is qualitatively similar to the diffraction profile of a liquid or ordinary window glass. On the other hand, a crystalline metal produces a diffraction profile in which intensity varies rapidly with diffraction angle.

These glassy metals exist in a metastable state. Upon heating to a sufficiently high temperature, they crystallize with evolution of a heat of crystallization, and the diffraction profile changes from one having glassy characteristics to one having crystalline characteristics.

It is possible to produce a metal which is a two-phase mixture of the glassy and the crystalline state; the relative proportions can vary from totally crystalline to totally glassy. A glassy metal, as employed herein, refers to a metal which is primarily glassy, but which may have a small fraction of the material present as included crystallites. Substantially glassy metals are preferred, due to an increase in ductility with an increase in glassiness.

For a suitable composition, proper processing will produce a metal in the glassy state. One typical procedure is to cause the molten alloy to be spread thinly in contact with a solid metal substrate, such as copper or aluminum, so that the molten metal rapidly loses its heat to the substrate.

When the alloy is spread to a thickness of about 0.002 inch, cooling rates of the order of $10^{6}$° C./sec may be achieved. See, for example, R. C. Ruhl, Vol. 1, *Materials Science & Engineering,* pp. 313–319 (1967), which discusses the dependence of cooling rates upon the conditions of processing the molten metal. For an alloy of proper composition and for a sufficiently high cooling rate, such a process produces a glassy metal. Any process which provides a suitably high cooling rate can be used. Illustrative examples of procedures which can be used to make the glassy metals include rotating double rolls, as described by H. S. Chen and C. E. Miller, Vol. 41, *Reviews of Scientific Instruments,* pp. 1237-1238 (1970), and rotating cylinder techniques, as described by R. Pond, Jr. and R. Maddin, Vol. 245, *Transactions of Metallurgical Society, AIME,* pp. 2475-2476 (1969).

Glassy alloys containing substantial amounts of one or more of the transition metals of iron, nickel, cobalt, vanadium and chromium have been disclosed by H. S. Chen and D. E. Polk in U.S. Pat. No. 3,856,513, issued Dec. 24, 1974. Such alloys are quite useful for a variety of applications. Such alloys, however, are characterized by a crystallization temperature of about 425° C. to 550° C. and a hardness of about 600 to 830 kg/mm$^2$.

SUMMARY OF THE INVENTION

In accordance with the invention, a metal alloy which is primarily glassy is provided having a combination of a high crystallization temperature of at least about 700° C. and a high hardness value of at least about 1000 kg/mm$^2$. The glassy composition of the invention consists essentially of (a) about 15 to 25 atom percent of at least one metalloid selected from the group consisting of phosphorus, boron, carbon and silicon;

(b) about 20 to 40 atom percent of at least one metal selected from the group consisting of iron, cobalt, nickel, chromium, vanadium and aluminum, with the proviso that when the metalloid consists essentially of boron, then about 20 to 55 atom percent of at least one of iron and cobalt is employed; and (c) about 40 to 60 atom percent of at least one refractory metal selected from the group consisting of molybdenum, tungsten, tantalum and niobium, with the proviso that when the metalloid consists essentially of boron and the metal consists essentially of at least one of iron and cobalt, then about 25 to 60 atom percent of at least one of molybdenum and tungsten is employed.

Such metallic glasses are particularly useful in heat resistant applications at high temperatures (about 500° to 600° C.). Applications include use of these materials as electrodes in certain high temperature electrolytic cells and as reinforcement fibers in composite structural materials used in elevated temperature applications.

DETAILED DESCRIPTION OF THE INVENTION

Most presently-known liquid-quenched metallic glasses of various metalloid combinations evidence crystallization temperatures of about 425° C. to 550° C. and hardness values of about 650 to 830 kg/mm$^2$. In accordance with the present invention, metallic glass compositions are provided which have a combination of crystallization temperatures of at least about 700° C. and hardness values of at least about 1000 kg/mm$^2$. Many of these metallic glasses have crystallization temperatures in excess of 800° C. and/or hardness values approaching 2000 kg/mm$^2$.

The glassy compositions of the invention consist essentially of (a) about 15 to 25 atom percent of at least one metalloid selected from the group consisting of phosphorus, boron, carbon and silicon;

(b) about 20 to 40 atom percent of at least one metal selected from the group consisting of iron, cobalt, nickel, chromium, vanadium and aluminum, with the proviso that when the metalloid consists essentially of boron, then about 20 to 55 atom percent of at least one of iron and cobalt is employed; and (c) about 40 to 60 atom percent of at lease one refractory metal selected from the group consisting of molybdenum, tungsten, tantalum and nobium, with the proviso that when the metalloid consists essentially of boron and the metal consists essentially of at least one of iron and cobalt, then about 25 to 65 atom percent of at least one of molybdenum and tungsten is employed. Substantial departure from the indicated ranges results in either the formation of brittle, crystalline material or the formation of materials having unacceptably low crystallization temperatures and/or hardness values. The purity of all compositions is that found in normal commercial practice. Further, additions of minor amounts of other elements may be made without affecting the basic nature of the composition.

Metallic glasses evidencing the highest hardness values yet measured, consistent with crystallization temperatures of about 700° C. and higher, consist essentially of about 15 to 25 atom percent boron, about 20 to 55 atom percent of at least one of iron and cobalt and about 25 to 60 atom percent of at least one of molybdenum and tungsten. Such glasses evidence hardness values of at least about 1450 kg/mm$^2$ and are accordingly preferred.

The maximum combination of high crystallization temperature and high hardness value is achieved for compositions consisting essentially of about 20 atom percent boron, about 30 to 40 atom percent of at least one of iron and cobalt and about 40 to 50 atom percent of at least one of molybdenum and tungsten. Accordingly, such compositions are most preferred. Examples of such metallic glasses include $Mo_{40}Fe_{40}B_{20}$ and $Mo_{40}Fe_{20}Co_{20}B_{20}$.

High values of crystallization temperature and hardness are also formed in compositions in which the refractory metal content ranges from about 45 to 55 atom percent, the metal content ranges from about 25 to 35 atom percent, and the metalloid content ranges from about 18 to 22 atom percent. Accordingly, this composition range is also preferred.

For Mo-base compositions, glassy alloys are formed in systems containing at least about 25 atom percent of iron, nickel, chromium, vanadium and/or aluminum. Typical compositions in atom percent are $Mo_{52}Cr_{10}Fe_{10}Ni_8P_{12}B_8$ and $Mo_{40}Cr_{25}Fe_{15}B_8C_7Si_5$. Such glassy alloys possess high thermal stability as revealed by DTA (differential thermal analysis) investigation. The temperatures for crystallization peaks, $T_c$, can be accurately determined from DTA by slowly heating the glassy alloy and noting whether excess heat is evolved at a particular temperature (crystallization temperature) or whether excess heat is absorbed over a particular temperature range (glass transition temperature). In general, the less well-defined glass transition temperature $T_g$ is considered to be within about 50° below the lowest, or first, crystallization peak, $T_{c1}$, and, as is conventional, encompasses the temperature region over which the viscosity ranges from about $10^{13}$ to $10^{14}$ poise.

The various Mo-base glasses with about 25 to 32 atom percent iron, nickel, chromium and/or aluminum plus about 12 atom percent phosphorus and about 8 atom percent boron, crystallize in the range of about 800° C. to 900° C. Replacing phosphorus by 6 to 8 atom percent of either carbon or silicon increases $T_c$ by about 40° C. to 50° C. Increased thermal stability is achieved by partial substitution of tungsten for molybdenum. Alloys containing about 8 to 20 atom percent tungsten substituted for molybdenum have crystallization temperatures in the range of about 900° C. to 950° C. and accordingly are preferred.

High $T_g$ glass-forming compositions exist also in W-base alloys. Typically, these alloys consist essentially of about 20 atom percent of at least one metalloid selected from the group consisting of phosphorus, boron, carbon and silicon, about 20 to 35 atom percent of at least one metal selected from the group consisting of iron, nickel and chromium, about 15 to 25 atom percent molybdenum and about 30 to 40 atom percent tungsten. These alloy glasses are remarkably stable and crystallize at temperatures in excess of 950° C. For example, one glass composition, $W_{40}Mo_{15}Cr_{15}Fe_5Ni_5P_6B_6C_5Si_3$, evidences two crystalization peaks, at 960° C. and 980° C., in a DTA trace. However, as the tungsten content is increased beyond about 40 atom percent, it becomes increasingly difficult to form a glass.

The metallic glasses of the invention are formed by cooling a melt at a rate of at least about $10^{5}$° C./sec. A variety of techniques are available, as is well-known in the art, for fabricating splat-quenched foils and rapid-quenched continuous ribbon, wire, etc. Typically, a particular composition is selected, powders or granules of the requisite elements (or compounds that decompose to the requisite elements, such as ferroboron, ferrosilicon, etc.) in the desired proportions are melted and homogenized, and the molten alloy is rapidly quenched on a chill surface, such as a rapidly rotating cylinder.

The metallic glasses of the invention also evidence high ductility and high corrosion resistance, compared to crystalline or partially crystalline samples.

EXAMPLE 1

A pneumatic arc-splat unit for melting and liquid quenching high temperature reactive alloys was used. The unit, which was a conventional arc-melting button furnace modified to provide "hammer and anvil" splat quenching of alloys under inert atmosphere, included a stainless steel chamber connected with a 4 inch diffusion pumping system. The quenching was accomplished by providing a flat-surfaced water-cooled copper hearth on the floor of the chamber and a pneumatically driven copper-block hammer poised above the molten alloy. As is conventional, arc-melting was accomplished by negatively biasing a copper shaft provided with a tungsten tip inserted through the top of the chamber and by positively biasing the bottom of the chamber. Alloys containing phosphorus were prepared by sintering powder ingredients followed by arc-melting to homogenization. All other alloys were prepared directly by repeated arc-melting of constituent elements. A single alloy button (about 200 mg) was remelted and then "impact-quenched" into a foil about 0.004 inch thick by the hammer situated just above the molten pool. The cooling rate attained by this technique was about $10^5$ to $10^{6}$° C./sec. The foils were checked for glassiness by X-ray diffraction and DTA.

The impact-quenched foil directly beneath the hammer may have suffered plastic deformation after solidification. However, portions of the foil formed from the melt spread away from the hammer were undeformed and hence suitable for hardness and other related tests. Crystallization temperature was measured by conventional differential thermal analysis, employing a heating rate of about 20° C./min. Hardness was measured by the diamond pyramid technique, using a Vickers-type indenter consisting of a diamond in the form of a square-based pyramid with an included angle to 136° between opposite faces.

The crystallization temperatures and hardness values are shown in Table I for a variety of compositions within the scope of the invention. Included for comparison are compositions outside the scope of the invention. The latter compositions are seen either to form crystalline products even at the high quench rates employed herein or to possess crystallization temperatures considerably below about 700° C.

TABLE I

| Composition, atom % | Crystallization Temperature, ° C | Hardness, Value, kg/mm$^2$ |
|---|---|---|
| Compositions outside the scope of the invention: | | |
| $Mo_{80}P_{20}$ | crystalline | |
| $Mo_{80}B_{20}$ | " | |
| $Mo_{80}P_{12}B_8$ | " | |
| $Mo_{50}Nb_{15}Fe_{10}Cr_5P_{15}B_5$ | " | |
| $Mo_{48}Ta_{32}P_{12}B_8$ | " | |
| $Mo_{48}Nb_{32}P_{12}B_8$ | " | |
| $Mo_{40}W_{30}Ni_{10}P_{14}B_6$ | " | |
| $Mo_{40}Ti_{40}P_{12}B_8$ | " | |
| $Mo_{30}W_{12}Ta_{18}Nb_{20}P_7B_6C_4Si_3$ | | |
| $Mo_{30}Ni_{50}P_{13}B_6Si_1$ | 559; 608 | 1077 |
| $Mo_{20}Ni_{45}Fe_{15}P_{14}B_6$ | 440 | — |
| $Mo_{30}Fe_{30}Ni_{10}Al_5Cr_5P_{13}B_6Si_1$ | 640 | — |
| $Mo_{15}W_5Ni_{50}Fe_{10}P_{15}B_5$ | 495 | — |
| $Mo_{10}W_{10}Ni_{60}P_{15}B_5$ | 478 | — |
| $W_{80}B_{20}$ | crystalline | |
| $W_{80}C_{20}$ | " | |
| $W_{80}P_{20}$ | " | |
| $W_{59}Mo_{21}Si_{10}B_6C_4$ | " | |
| $Ta_{80}P_{20}$ | " | |
| $Ta_{80}B_{20}$ | " | |
| $Ta_{80}P_{12}B_8$ | " | |
| $Nb_{80}B_{20}$ | " | |
| $Nb_{80}P_{20}$ | " | |
| Compositions within the scope of the invention: | | |
| $Mo_{60}Cr_{20}P_{12}B_8$ | 80% glassy | |
| $Mo_{48}Al_{32}P_{12}B_8$ | 50% glassy | |
| $Mo_{48}Cr_{32}P_{12}B_8$ | 878 | — |
| $Mo_{48}Fe_{32}P_{12}B_8$ | 828; 855 | — |
| $Mo_{48}Ni_{32}P_{12}B_8$ | 805 | — |

TABLE I-continued

| Composition, atom % | Crystallization Temperature, ° C | Hardness, Value, kg/mm$^2$ |
|---|---|---|
| $Mo_{50}Fe_{10}Al_{20}P_{10}B_7Si_3$ | 837 | 1026 |
| $Mo_{52}Cr_{14}Fe_{14}P_{12}B_8$ | 863; 888 | 1260 |
| $Mo_{52}Cr_{10}Fe_{10}Ni_8P_{12}B_8$ | 831 | 1234 |
| $Mo_{40}Cr_{25}Fe_{15}B_8C_7Si_5$ | 913 | — |
| $Mo_{40}W_{10}Cr_{30}P_{15}B_5$ | 881 | — |
| $Mo_{35}W_{20}Cr_{18}Fe_7P_6B_6C_5Si_3$ | 950; 986 | — |
| $Mo_{40}W_{15}Cr_{18}Fe_7P_6B_6C_5Si_3$ | 894; 948 | — |
| $Mo_{35}W_{15}Cr_{25}Fe_5P_6B_6C_5Si_3$ | 920 | — |
| $Mo_{40}W_8Cr_{24}Fe_8P_6B_6C_5Si_3$ | 902 | 1392 |
| $Mo_{30}Nb_{20}Cr_{30}P_8B_7Si_5$ | 903 | 1187 |
| $W_{30}MO_{25}Cr_{18}Fe_7P_6B_6C_5Si_3$ | 950 | 1350 |
| $W_{35}Mo_{20}Cr_{15}Fe_5Ni_5P_6B_6C_5Si_3$ | 946; 970 | 1378 |
| $W_{40}Mo_{15}Cr_{15}Fe_5Ni_5P_6B_6C_5Si_3$ | 960; 980 | 1396 |

EXAMPLE 2

Ribbons about 2.5 to 6.5 mm wide and about 40 to 60 μm thick were formed by squirting a melt of the particular composition by overpressure of argon onto a rapidly rotating chill wheel (surface speed about 3000 to 6000 ft/sec). Chill wheels comprising either molybdenum or a precipitation-hardened copper beryllium alloy were variously employed. Metastable, homogeneous ribbons of substantially glassy alloys were produced.

As in Example 1, cooling rates of at least about $10^{5}$° C./sec were attained. Glassiness was determined as in Example 1, as were crystallization temperature and hardness value.

The crystallization temperatures and hardness values of ribbons of preferred molybdenum-boron-base and tungsten-boron-base compositions within the scope of the invention are shown in Table II. Included for comparison are compositions outside the scope of the invention which do not possess the combination of high crystallization temperatures of about 700° C. and higher and high hardness values of at least about 1450 kg/mm$^2$, as provided by compositions within the scope of the invention.

TABLE II

A. Molybdenum Base.

| Composition, atom percent Mo | Fe | Co | Ni | B | Crystallization Temperature, ° C | Hardness Value, kg/mm$^2$ |
|---|---|---|---|---|---|---|
| Compositions outside the scope of the invention: | | | | | | |
| — | 80 | — | — | 20 | 465 | 1100 |
| — | — | 80 | — | 20 | — | 1100 |
| 20 | 63.5 | — | — | 16.5 | 640 | 1340 |
| Compositions within the scope of the invention: | | | | | | |
| 25 | 55 | — | — | 20 | 690; 730 | 1480 |
| 27.5 | 52.5 | — | — | 20 | 705; 760 | 1510 |
| 30 | 50 | — | — | 20 | 725; 800; 850 | 1550 |
| 40 | 40 | — | — | 20 | 852; 902 | 1950 |
| 50 | 30 | — | — | 20 | 860; 910 | 1750 |
| 55 | 25 | — | — | 20 | 906 | 1750 |
| 60 | 20 | — | — | 20 | 890; 960; 1080 | 1750 |
| 65 | 25 | — | — | 20 | — | 1750 |
| 25 | — | 55 | — | 20 | 695; 736 | 1480 |
| 27.5 | — | 52.5 | — | 20 | 710; 767 | 1530 |
| 30 | — | 50 | — | 20 | 721; 729 | 1700 |
| 40 | — | 40 | — | 20 | 790; 848 | 1700 |
| 50 | — | 30 | — | 20 | 851; 896; 927 | 1650 |
| 60 | — | 20 | — | 20 | 877; 949; 1042 | 1650 |
| 65 | — | 15 | — | 20 | 856; 956 | 1700 |
| 40 | — | — | 40 | 20 | — | 1500 |
| 50 | — | — | 30 | 20 | — | 1450 |
| 60 | — | — | 20 | 20 | — | 1500 |
| 30 | 20 | 30 | — | 20 | 755; 834 | 1600 |
| 40 | 20 | 20 | — | 20 | 835; 890 | 1750 |
| 50 | 15 | 15 | — | 20 | 870; 898; 945 | 1780 |
| 50 | 20 | 10 | — | 20 | — | 1770 |
| 60 | 10 | 10 | — | 20 | — | 1780 |
| 50 | — | 15 | 15 | 20 | — | 1650 |

TABLE II-continued

B. Tungsten Base.

| Composition, atom percent W | Fe | B | Hardness Value, kg/mm$^2$ |
|---|---|---|---|
| 25 | 57 | 18 | 1650 |
| 27 | 55 | 18 | 1681 |
| 31 | 51 | 18 | 1747 |

What is claimed is:

1. A metal alloy which is primarily glassy and has high crystallization temperature and high hardness, characterized in that the metal alloy consists essentially of (a) about 15 to 25 atom percent of at least one metalloid selected from the group consisting of phosphorus, boron, carbon and silicon;

(b) about 20 to 40 atom percent of least one metal selected from the group consisting of nickel, chromium, iron vanadium, cobalt and aluminum, with the proviso that when the metalloid consists essentially of boron, then about 20 to 55 atom percent of at least one of iron and cobalt is employed; and (c) about 40 to 60 atom percent of at least one refractory metal selected from the group consisting of molybdenum, tungsten, tantalum and niobium, with the proviso that when the metalloid consists essentially of boron and the metal consists essentially of at least one of iron and cobalt, then about 25 to 60 atom percent of at least one of molybdenum and tungsten is employed.

2. The glassy metal alloy of claim 1 which is substantially glassy.

3. The glassy metal alloy of claim 1 consisting essentially of about 15 to 25 atom percent boron, about 20 to 55 atom percent of at least one metal selected from the group consisting of iron and cobalt and about 25 to 60 atom percent of at least one refractory metal selected from the group consisting of molybdenum and tungsten.

4. The glassy metal alloy of claim 3 consisting essentially of about 20 atom percent boron, about 30 to 40 atom percent of at least one metal selected from the group consisting of iron and cobalt and about 40 to 50 atom percent of at least one refractory metal selected from the group consisting of molybdenum and tungsten.

5. The glassy alloy of claim 4 consisting essentially of about 20 atom percent boron, about 40 atom percent iron and about 40 atom percent molybdenum.

6. The glassy alloy of claim 4 consisting essentially of about 20 atom percent boron, about 20 atom percent cobalt, about 20 atom percent iron and about 40 atom percent molybdenum.

7. The glassy alloy of claim 1 consisting essentially of about 18 to 22 atom percent of at least one metalloid selected from the group consisting of phosphorus, boron, carbon and silicon, about 25 to 35 atom percent of at least one metal selected from the group consisting of iron, cobalt, nickel, chromium, vanadium and aluminum and about 45 to 55 atom percent of at least one refractory metal selected from the group consisting of molybdenum, tungsten, tantalum and niobium.

8. The glassy alloy of claim 1 in which the refractory metal is at least one of molybdenum and tungsten.

9. The glassy alloy of claim 8 in which the refractory metal is molybdenum.

10. The glassy alloy of claim 9 containing at least about 25 atom percent of at least one metal selected from the group consisting of nickel, chromium, iron and aluminum.

11. The glassy alloy of claim 10 containing about 25 to 32 atom percent of at least one metal selected from the group consisting of nickel, chromium, iron and aluminum, about 12 atom percent phosphorus and about 8 atom percent boron.

12. The glassy alloy of claim 11 in which about 6 to 8 atom percent of phosphorus is replaced by at least one metalloid selected from the group consisting of carbon and silicon.

13. The glassy alloy of claim 10 in which about 8 to 20 atom percent of molybdenum is replaced by tungsten.

14. The glassy alloy of claim 8 consisting essentially of about 20 atom percent of at least one metalloid selected from the group consisting of phosphorus, boron, carbon and silicon, about 20 to 35 atom percent of at least one metal selected from the group consisting of nickel, iron and chromium, about 15 to 25 atom percent molybdenum and about 30 to 40 atom percent tungsten.

* * * * *